US010415574B2

(12) United States Patent
Almishari

(10) Patent No.: US 10,415,574 B2
(45) Date of Patent: Sep. 17, 2019

(54) SYSTEM AND METHOD OF A FAN

(71) Applicant: Ibrahim Almishari, Durrat al Bahrain (BH)

(72) Inventor: Ibrahim Almishari, Durrat al Bahrain (BH)

( * ) Notice: Subject to any disclaimer, the term of this patent is extended or adjusted under 35 U.S.C. 154(b) by 330 days.

(21) Appl. No.: 15/314,755

(22) PCT Filed: May 28, 2015

(86) PCT No.: PCT/IB2015/054033

§ 371 (c)(1),
(2) Date: Nov. 29, 2016

(87) PCT Pub. No.: WO2015/181774

PCT Pub. Date: Dec. 3, 2015

(65) Prior Publication Data

US 2017/0198700 A1 Jul. 13, 2017

Related U.S. Application Data

(60) Provisional application No. 62/005,414, filed on May 30, 2014.

(51) Int. Cl.
*F04D 25/08* (2006.01)
*F04D 29/32* (2006.01)
(Continued)

(52) U.S. Cl.
CPC ..... *F04D 25/088* (2013.01); *F04D 19/00* (2013.01); *F04D 19/002* (2013.01);
(Continued)

(58) Field of Classification Search
CPC ..... B64C 27/467; B64C 27/82; B64C 27/473; B64C 27/72; B64C 2027/7222;
(Continued)

(56) References Cited

U.S. PATENT DOCUMENTS 1,866,127 A 7/1932 Persons
3,768,546 A 10/1973 Shipes
(Continued)

FOREIGN PATENT DOCUMENTS

GB 1372962 11/1974
JP H05123522 5/1993

OTHER PUBLICATIONS

International Search Report and Written Opinion for PCT Application No. PCT/IB2015/054033, dated Aug. 11, 2015.

*Primary Examiner* — Charles G Freay
(74) *Attorney, Agent, or Firm* — Conley Rose, P.C.; William H. Dietrich

(57) ABSTRACT

A fan apparatus is described that comprises a rotational hub that defines a central axis, a first fan blade coupled to the rotational hub and extending radially outward from the central axis, wherein the first fan blade has a first pitch angle; a second fan blade coupled to the rotational hub and extending radially outward from the first central axis, wherein the second fan blade has a second pitch angle opposite the first pitch angle; and a housing that defines cylindrical interior volume with a central axis coaxial with the central axis of the rotational hub, wherein the first and second fan blades reside within the cylindrical interior volume.

18 Claims, 6 Drawing Sheets

(51) Int. Cl.
*F04D 19/00* (2006.01)
*F04D 23/00* (2006.01)
*F04D 25/06* (2006.01)

(52) U.S. Cl.
CPC ..... *F04D 23/006* (2013.01); *F04D 25/06* (2013.01); *F04D 29/327* (2013.01)

(58) Field of Classification Search
CPC ..... B64C 2027/7283; Y02T 50/34; Y02E 10/721; F04D 25/088; F04D 29/327; F04D 19/002; F04D 23/006
USPC ..... 416/5, 175, 203, 210 R
See application file for complete search history.

(56) References Cited

U.S. PATENT DOCUMENTS 4,049,363 A 9/1977 Baumann et al.
4,221,541 A 9/1980 Bianchi
4,306,839 A * 12/1981 Pien ..... B63H 1/20 416/200 R
4,863,351 A * 9/1989 Fischer ..... B64C 11/00 416/203
4,867,643 A 9/1989 Appleton
5,632,661 A 5/1997 Juergens et al.
5,735,670 A * 4/1998 Moffitt ..... B64C 11/003 244/1 N
6,220,906 B1 4/2001 Dubois
6,644,922 B2 11/2003 McCallum et al.
6,648,602 B2 11/2003 Horng et al.
7,459,870 B2 12/2008 Beck et al.
7,726,945 B2 * 6/2010 Grant ..... F04D 25/088 416/134 R
7,841,831 B2 11/2010 Chen
8,061,993 B2 11/2011 Sassow
8,221,069 B2 7/2012 Ogino et al.
8,449,252 B2 5/2013 Van Otten et al.
2010/0278637 A1 * 11/2010 Oleson ..... F04D 25/088 415/121.3
2012/0321481 A1 12/2012 De Jesus
2013/0170942 A1 7/2013 Claerhout
2014/0086729 A1 3/2014 Peery et al.

* cited by examiner

SYSTEM AND METHOD OF A FAN

BACKGROUND

Current fans require an ample volume of air surrounding the blades in order to create sufficient airflow. For example, a ceiling fan is hung with enough space between the top of the blades and the ceiling to enable airflow behind and through the blades as the blades rotate. In some circumstances, however, space is limited, and thus a conventional fan may not provide sufficient, if any, airflow. Thus, a fan which would enable sufficient circulation in a smaller area would be beneficial.

BRIEF DESCRIPTION OF THE DRAWINGS

For a detailed description of various embodiments, reference will now be made to the accompanying drawings in which.

NOTATION AND NOMENCLATURE

Certain terms are used throughout the following description and claims to refer to particular system components. As one skilled in the art will appreciate, different companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection or through an indirect connection via other devices and connections.

"Exemplary" means serving as an example, instance, or illustration. An embodiment described herein as "exemplary" is not necessarily to be construed as preferred or advantageous over other embodiments.

"Chord line", in relation to a fan blade, shall mean a straight line extending between a leading edge and a trailing edge of the fan blade.

"Pitch angle" shall mean an angle between the chord line of a fan blade and a direction of travel of the fan blade. For purpose of measuring pitch angle for a fan blade moving circularly about a central axis, the direction of travel shall be a tangent to the circular travel.

"Turning about a central axis", in relation to a fan blade, shall mean the distal tip of the fan blade moves about a plane perpendicular to the central axis.

"Opposite" in relation to pitch angles as between two fan blades shall mean that, for the same circular direction of travel of the two fan blades, one pitch angle moves air in a first direction and the second pitch angle moves air in a second direction opposite the first direction.

"Reverse pitch" shall mean, as applied to a fan blade, having a pitch angle such that, in operation, the fan blade draws air from a room into a chamber.

"Forward pitch" shall mean, as applied to a fan blade, having an angular pitch such that when, in operation, rotation of the blade draws air from a room.

DETAILED DESCRIPTION

The following discussion is directed to various embodiments. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Various embodiments are directed to a fan. In particular, a fan comprised of an even number of blades that circulates air within a room. The specification first turns to a discussion of the fan with reference to FIG. 1.

Figure 1:
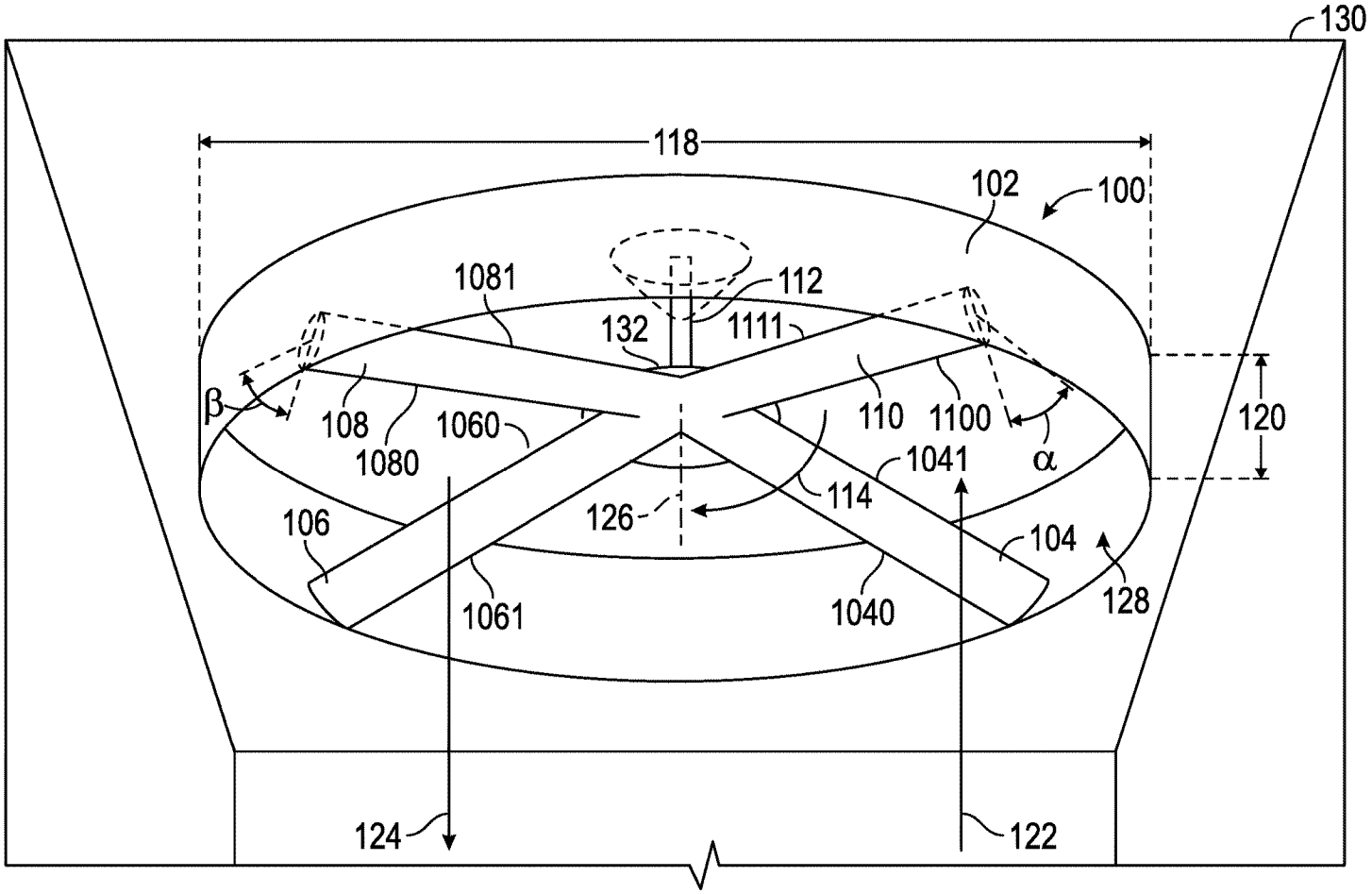
FIG. 1 shows a perspective view of a fan mounted on a ceiling in accordance with at least some embodiments.

FIG. 1 shows, in perspective view, a fan 100 attached to a ceiling 130. In particular, the fan 100 is comprised of a plurality of fan blades 104, 106, 108, and 110. The fan blades are coupled to a motor (not shown in FIG. 1) by way of a rod 112 coupled to a rotational hub 132 that defines a central axis 126. Fan blades 104, 106, 108, and 110 are coupled on a proximate end to the rotational hub 132 and extend radially outward from the central axis 126. In addition, fan blades 104, 106, 108, and 110 are encircled by a housing 102 which, when the fan is mounted in its operating position, in conjunction with a room ceiling or wall, for example, creates a chamber 128 defined by a volume of an area swept out by the fan blades when turned, the housing 102, and the ceiling 130. In an alternative embodiment, the chamber 128 may be defined by defined by a volume of an area swept out by the fan blades when turned, the housing 102, and a back wall separate from a room ceiling or room wall.

The fan 100 comprises an even number of fan blades coupled to the rotational hub 132. For example, FIG. 1 shows four fan blades 102, 106, 108 and 110, although any number of fan blades may be contemplated so long as the number of fan blades is an even number (e.g., four, six, eight, etc.). The fan blades may be constructed of any suitable material, such as metal, plastic, wood, or any other material capable of maintaining its form during the operation of the fan.

Housing 102 defines an internal diameter 118 large enough to contain the fan blades, and a depth or height 120. The volume of the area swept out by the fan blades when turned, the housing 102, and the ceiling 130 may also be large enough to contain the drive mechanism for the blades, such as an electric motor (not shown in FIG. 1). Although the example housing 102 has a circular internal diameter and a circular outside diameter, the outside surface of the housing 102 may be any shape and any size. The housing 102 may be made of any suitable material, such as weather-proof material, metal, aluminum, plastic, or wood. Although not specifically shown in FIG. 1, in certain situations (e.g., when the fan 100 is mounted on a vertical wall) the fan 100 may also comprise a grill. The grill enables air to pass into and out of the chamber defined by the housing 102 and the wall 206 or ceiling 130, and the grill aids in preventing objects from being stuck into the fan blades during operation.

Regardless of the number of fan blades, one half of the fan blades are angled with a reverse pitch that draws air from the room into chamber 128 wherein the air becomes pressurized. The other half of the fan blades are angled with a forward pitch that extracts air stored within chamber 128 and pushes the air back into the room. In the example of FIG. 1, the fan blades are rotating in a clockwise direction, as indicated by arrow 114. Fan blades 104 and 110 are oriented with a reverse pitch such that the trailing edges of the blades are tilted backwards away from the viewer, with the leading edges of the blades protruding forward closer to the viewer. Stated otherwise, in the view of FIG. 1, fan blades 104 and 110 are angled such that their respective leading edges 1040 and 1100 are below their respective trailing edges 1041 and 1111. In contrast, fan blades 106 and 108 are oriented with a forward pitch such that the leading edges of the fan blades are tilted towards the viewer, with the trailing edges of the fan blades pushed backwards away from the viewer. In other words, fan blades 106 and 108 are angled such that their respective leading edges 1060 and 1080 are above their respective trailing edges 1061 and 1081.

In an embodiment, for example, if fan blades 104 and 110 have at pitch angle $\alpha$, and fan blades 106 and 108 are tilted at pitch angle $\beta$, $\alpha$ and $\beta$ are opposing positive angles having the same degree of measurement. In other words, pitch angles $\alpha$ and $\beta$ have the same absolute value. In another embodiment, pitch angles $\alpha$ and $\beta$ are opposing angles but do not have the same degree of measurement.

The fan blades having corresponding pitch angle are placed next to one another in an adjacent fashion. For example, as described above, fan blades 104 and 110 have a corresponding pitch angle, and are thus adjacent to each other; and fan blades 106 and 108 have a corresponding pitch angle and are thus next to each other. If the reader were to now imagine six fan blades: 104, 106, 108, 110, and fan blades A and B (not shown), with fan blade A having a corresponding pitch angle as 104 and 110, and fan blade B having a corresponding pitch angle as blades 106 and 108, the fan blades would be attached in the following order going clockwise: 104, 110, A, 106, 108, B.

As the fan blades rotate around the central axis 126 of fan 100, half of the fan blades, those having the reverse pitch (i.e., 104 and 110) draw air from the room (shown by arrow 122) and push the air into chamber 128 residing behind the fan blades, thus trapping pressurized air within chamber 128. As the fan blades continue to rotate around the central axis 126, the other half of the fan blades, those having the forward pitch (i.e., 106 and 108) draw pressurized air from chamber 128 and push the air into the room (shown by arrow 124).

Figure 2:
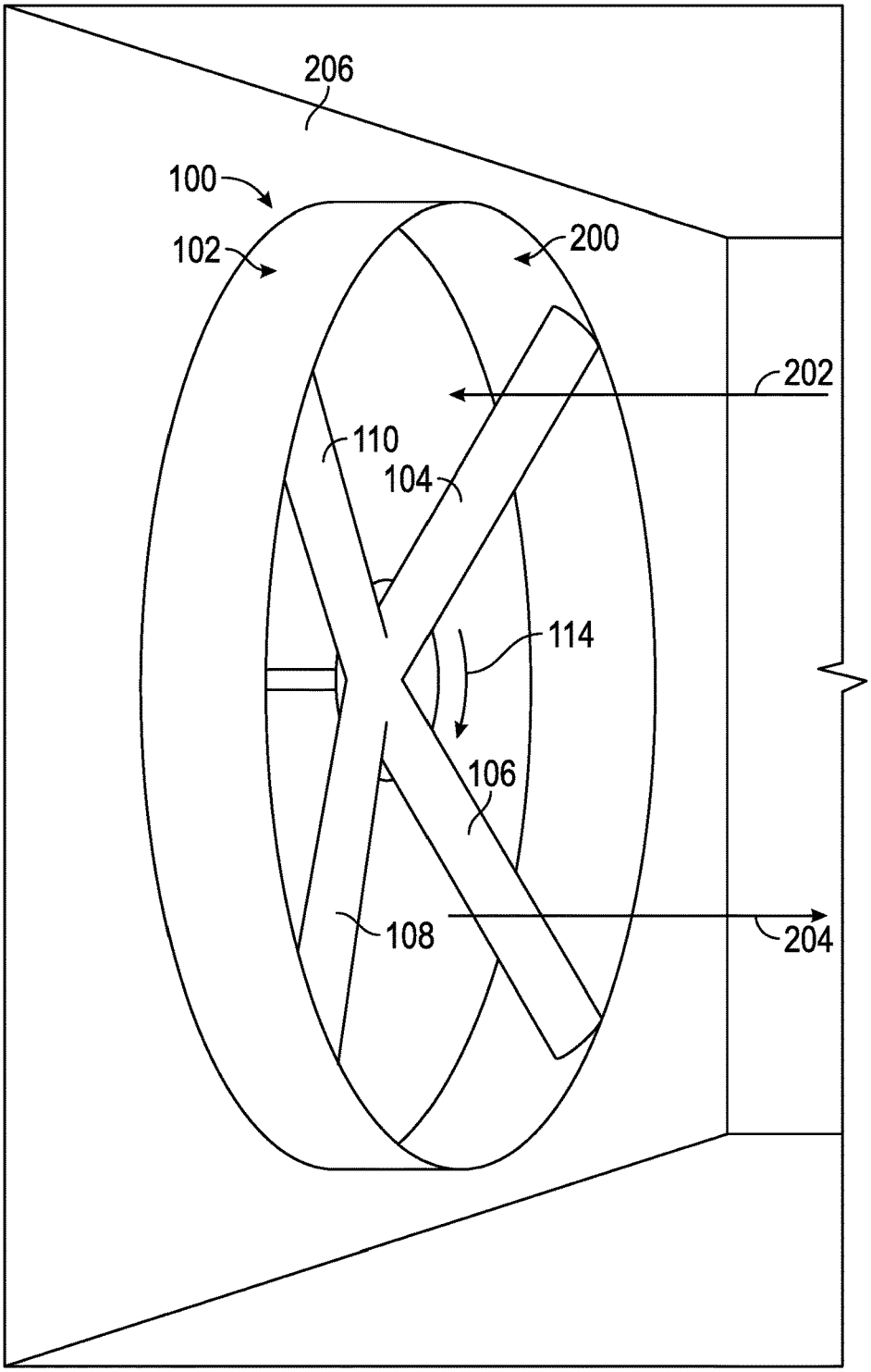
FIG. 2 shows a perspective view of a fan mounted on a wall in accordance with at least some embodiments.

Turning now to FIG. 2, FIG. 2 shows a perspective view of fan 100 attached to a wall 206. As described previously, the fan blades rotate around the central axis 126 of fan 100. Due to the angled orientation, fan blades 104 and 110 draw air from the room (shown by arrow 202) into the chamber 200 defined by a volume of an area swept out by the fan blades when turned, the housing 102, and the wall 206. The air enters the chamber 200 and is stored in the chamber 200 as localized areas of pressurized air. As fan blades 106 and 108 rotate around the central axis 126, and due to the opposite pitch from that of blades 104 and 110, blades 106 and 108 draw pressurized air from the chamber 200 and push it into the room (shown by arrow 204).

A drive mechanism (e.g., motor) (not shown in FIG. 2), may be disposed within chamber 200. In another embodiment, however, the drive mechanism may be placed behind chamber 200. In yet another embodiment, the drive mechanism may be coupled to the fan behind the fan blades, but in front of chamber 200. In yet another embodiment, the drive mechanism may be placed in front of the fan blades (i.e., in the center of the blades, atop the rotational hub 132).

Although not specifically shown, it should be understood that the fan 100 may be a box-type fan, a ceiling fan, a fan coupled to a wall, a desk fan, or any other type of indoor or outdoor fan which enables the methods and systems described herein. Furthermore, the fan 100 may be coupled to a light.

Figure 3A:
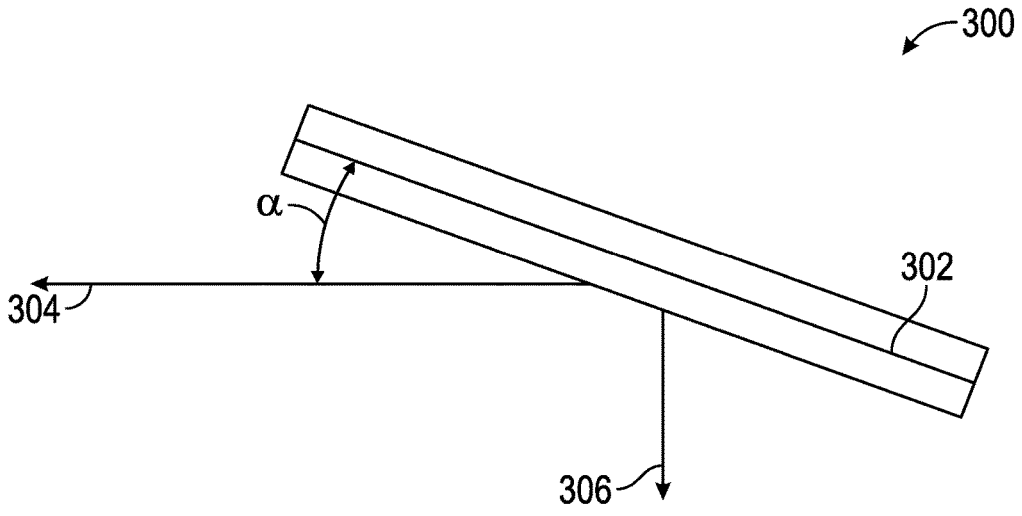
FIG. 3A shows a side elevation view of a fan blade in accordance with at least some embodiments.
Figure 3B:
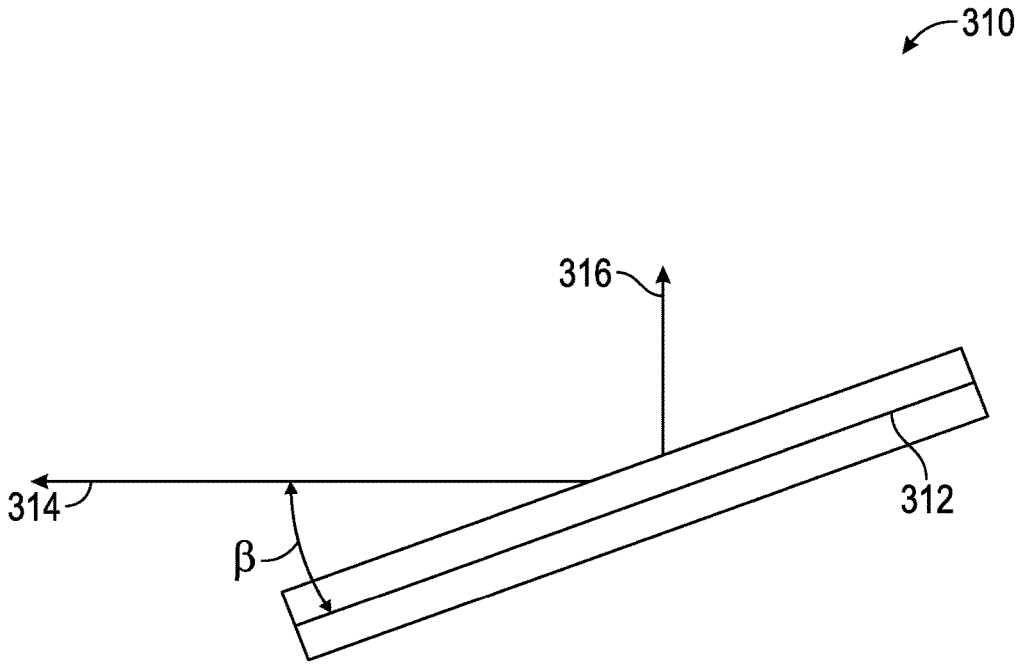
FIG. 3B shows a side elevation view of a fan blade in accordance with at least some embodiments.

Turning now to FIG. 3A, FIG. 3A is a side elevation view of fan blade 300 with pitch angle $\alpha$. Fan blade 300 travels in direction 304 about the central axis 126. As the fan blade 300 travels in direction 304, the air flows in direction 306. Pitch angle $\alpha$ is the angle between chord line 302 and the direction of travel 304. FIG. 3B is a side elevation view of fan blade 310 with pitch angle $\beta$. Fan blade 310 travels in direction 314 about central axis 126. As the fan blade turns in direction 314, the air flows in direction 316. Pitch angle $\beta$ is the angle between chord line 312 and the direction of travel 314. In an embodiment, fan blade 300 with pitch angle $\alpha$ is exemplary of fan blades 104 and 110 as shown in FIG. 1. Further, fan blade 310 with pitch angle $\beta$ is exemplary of fan blades 106 and 108 as shown in FIG. 1.

Figure 4:
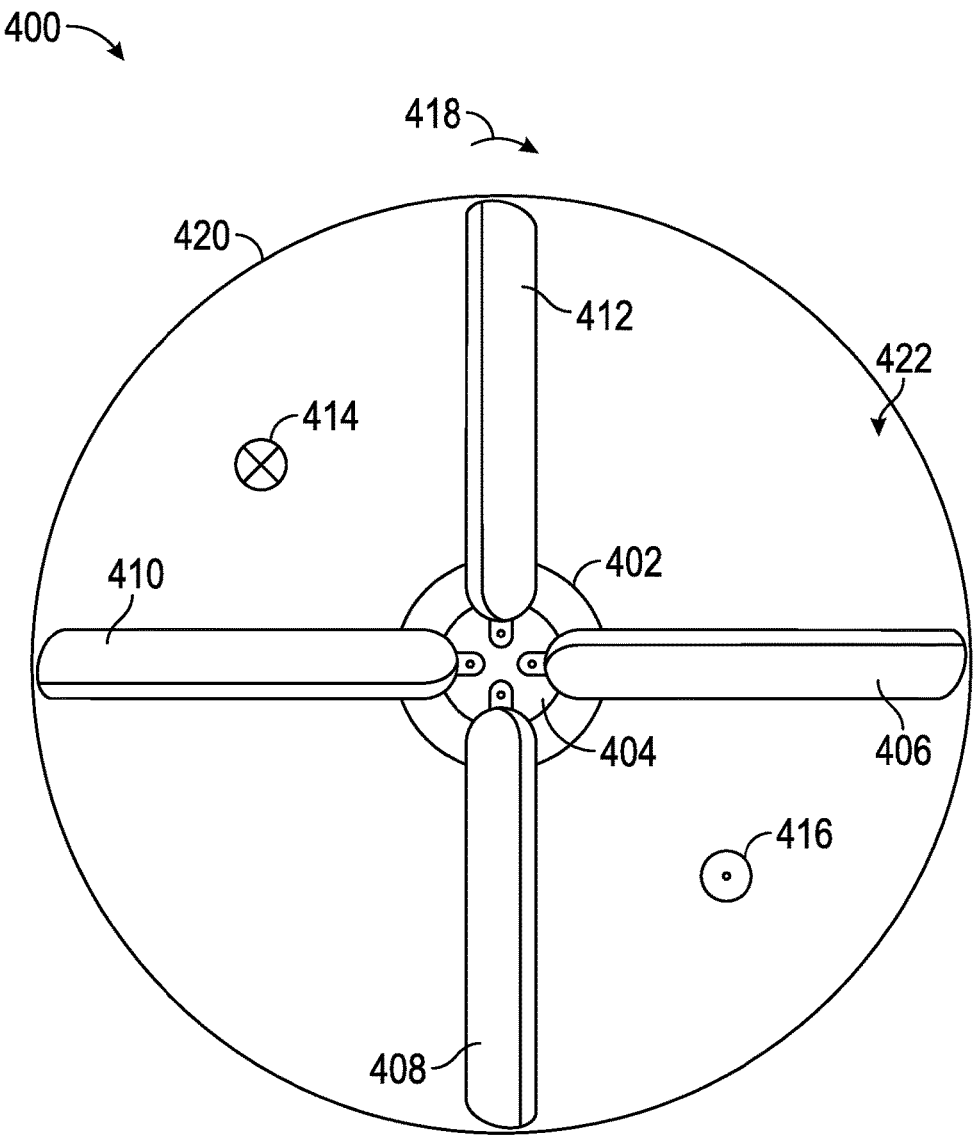
FIG. 4 shows an elevation view of a fan in accordance with at least some embodiments.

FIG. 4 is an elevation view of an embodiment of fan 400 containing four fan blades 406, 408, 410 and 412 coupled to rotational hub 404 and extending radially outward from the central axis 128 (not shown in FIG. 4). The fan blades turn in direction 418 around rotational hub 404 coupled to electric motor 402. Fan blades 410 and 412 have a reverse pitch and draw air in direction 414, from the room and into the chamber 422 defined by a volume of an area swept out by the fan blades when turned, a housing 420, and a ceiling or wall. Fan blades 406 and 408 have a forward pitch and push air in direction 416, out of chamber 422 and into the room.

Figure 5:
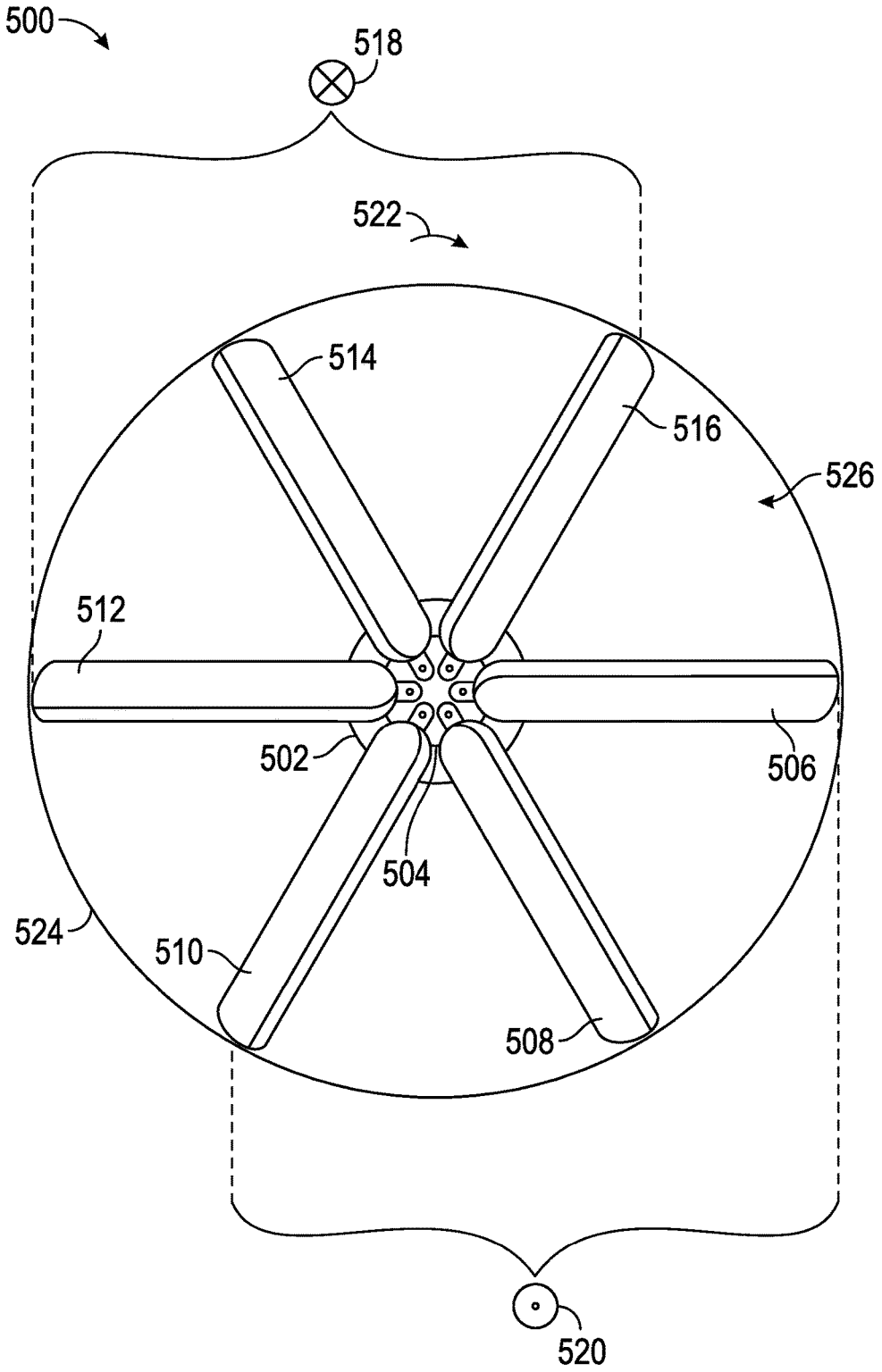
FIG. 5 shows an elevation view of a fan in accordance with at least some embodiments.

FIG. 5 is an elevation view of embodiment of fan 500 containing six fan blades, 506, 508, 510, 512 and 514, coupled to rotational hub 504 and extending radially outward from the central axis 128 (not shown in FIG. 5). The fan blades turn in direction 522 around rotational hub 504 coupled to electric motor 502. Fan blades 512, 514, and 516 have a reverse pitch and draw air in direction 518, from the room and into chamber 526 defined by a volume of an area swept out by the fan blades when turned, a housing 524, and a ceiling or wall. Fan blades 506, 508 and 510 have a forward pitch and push air in direction 520, out of chamber 526 and into the room.

Figure 6:
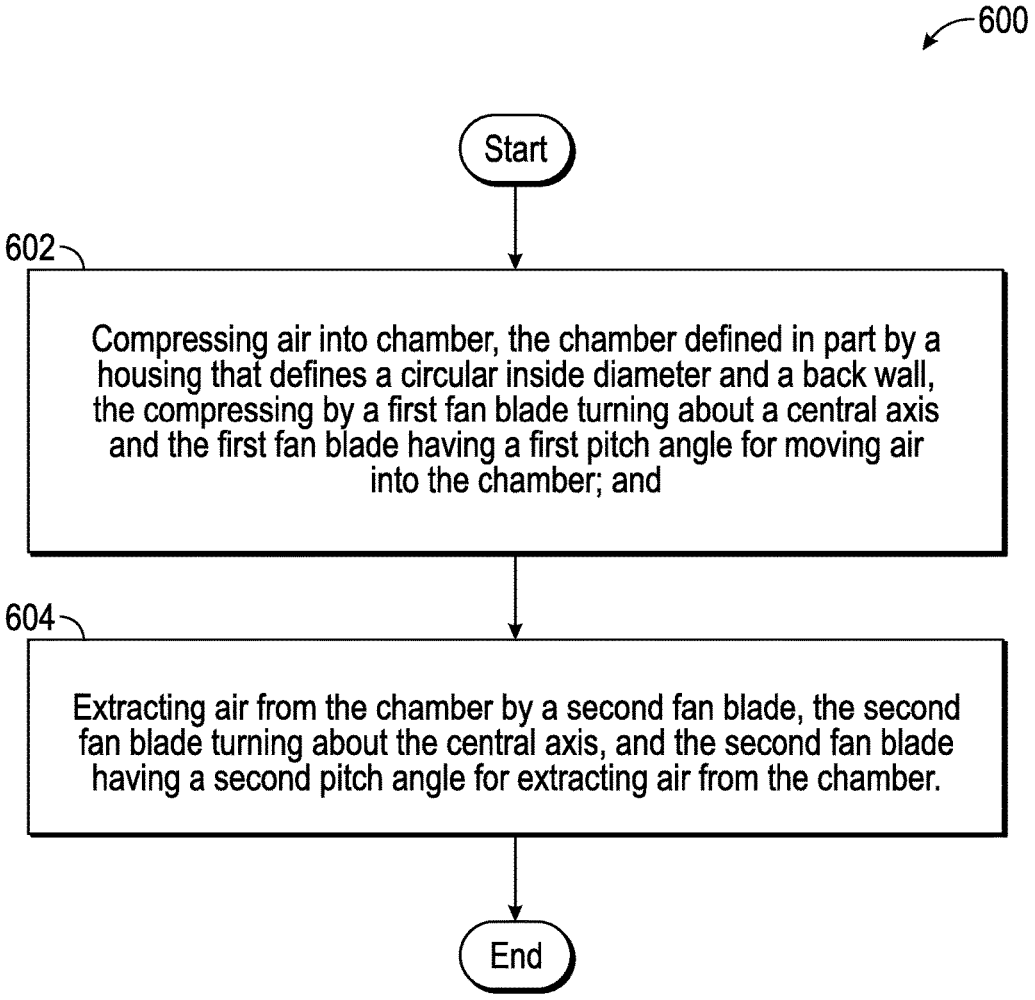
FIG. 6 is a flow chart illustrating a method in accordance with at least some embodiments.

Turning now to FIG. 6, a method 600 is described according to an embodiment. At block 602, as the fan blades rotate around a central axis, air is compressed into the chamber of the fan 100. For example, air is drawn from the room and into the chamber (defined by the volume of an area swept out by the fan blades when turned, the housing 102, and the ceiling or wall) by fan blades having a reverse pitch. At block 604, as the fan blades rotate about a central axis, air is extracted from the chamber and pushed into the room by fan blades having a forward pitch.

The various embodiments, in one theory of operation, refer to a fan for storing and moving pressurized air, but are not solely limited to such a system, and may be implemented on any system. In an alternative theory of operation, at slower speeds, such as 30 rpm or less, localized areas of pressure may cause air to circulate through the chamber, i.e. air flows within and across the chamber. Such an alternative theory of operation is not inconsistent with the embodiments discussed herein and does not avoid infringement. References to "one embodiment", "an embodiment", "a particular embodiment", "some embodiments", "various embodiments", and "example embodiments" indicate that a particular element or characteristic is included in at least one embodiment of the invention. Although the illustrative phrases may appear in various places, these do not necessarily refer to the same embodiment.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A method of operating a fan comprising:

compressing air into a chamber, the chamber defined in part by a housing that defines a circular inside diameter and a back wall, the compressing by a first fan blade turning about a central axis, and the first fan blade having a constant first pitch angle for moving air into the chamber; and extracting air from the chamber by a second fan blade, the second fan blade turning about the central axis, and the second fan blade having a constant second pitch angle for extracting air from the chamber, wherein the constant second pitch angle is opposite the constant first pitch angle.

2. The method of claim 1, wherein the air is compressed and extracted by the first and second blades having equal and opposite pitch angles.

3. The method of claim 1 further comprising:

compressing air into the chamber by a third fan blade turning about the central axis, the third fan blade having a third pitch angle for moving air into the chamber, and the third fan blade extending radially outward from the central axis opposite the second fan blade; and extracting air from the chamber by a fourth fan blade turning about the central axis, the fourth fan blade having a fourth pitch angle for extracting air from the chamber, and the fourth fan blade extending radially outward from the central axis opposite the first fan blade.

4. The method of claim 3 further comprising:

compressing air into the chamber by a fifth fan blade turning about the central axis, the fifth fan blade having a fifth pitch angle for moving air into the chamber, and the third fan blade extending radially outward from the central axis between the first and third fan blades; and extracting air from the chamber by a sixth fan blade turning about the central axis, the sixth fan blade having a sixth pitch angle for extracting air from the chamber, and the sixth fan blade extending radially outward from the central axis between the second and fourth fan blades.

5. The method of claim 1, wherein the air is compressed into and extracted from the chamber defined in part by a ceiling of a room.

6. The method of claim 1, wherein the air is compressed into and extracted from the chamber defined in part by a wall of a room.

7. A fan apparatus comprising:

a rotational hub that defines a central axis;

a first fan blade coupled to the rotational hub and extending radially outward from the central axis, the first fan blade having a constant first pitch angle;

a second fan blade coupled to the rotational hub and extending radially outward from the central axis, the second fan blade having a constant second pitch angle opposite the constant first pitch angle; and a housing that defines cylindrical interior volume with a central axis coaxial with the central axis of the rotational hub, wherein the first and second fan blades reside within the cylindrical interior volume.

8. The apparatus of claim 7, wherein an absolute value of the constant first pitch angle is the same as the absolute value of the constant second pitch angle.

9. The apparatus of claim 7, further comprising:

a third fan blade coupled to the rotational hub and extending radially outward from the central axis opposite the second fan blade, the third fan blade has the constant first pitch angle; and a fourth fan blade coupled to the rotational hub and extending radially outward from the central axis opposite the first fan blade, the fourth fan blade has the constant second pitch angle.

10. The apparatus of claim 9, further comprising:

a fifth fan blade coupled to the rotational hub and extending radially outward from the central axis between the first and third fan blades, the fifth fan blade has the constant first pitch angle; and a sixth fan blade coupled to the rotational hub and extending radially outward from the central axis between the second and fourth fan blades, the sixth fan blade has the constant second pitch angle.

11. The apparatus of claim 7, further comprising the fan apparatus having an even number of fan blades.

12. The apparatus of claim 7, wherein the fan blades are comprised of at least one selected from the group consisting of: metal; plastic; and wood.

13. The apparatus of claim 7, wherein the housing is comprised of at least one selected from the group consisting of: weather-proof material; metal; plastic; and wood.

14. The apparatus of claim 7, further comprising a motor, wherein the motor is coupled to the rotational hub.

15. The apparatus of claim 7, further comprising a motor, wherein the motor is coupled to the housing.

16. The apparatus of claim 7, wherein the housing is mounted to a ceiling.

17. The apparatus of claim 7, wherein the housing is mounted to a wall.

18. The apparatus of claim 7, wherein the first and second fan blades reside fully within the cylindrical interior volume of the housing.

* * * * *